US005746034A

United States Patent [19]

Luchetti et al.

[11] Patent Number: 5,746,034

[45] Date of Patent: May 5, 1998

[54] PARTITION SYSTEM

[75] Inventors: Robert J. Luchetti, Cambridge; Gregg Robert Draudt, Watertown, both of Mass.; James Bender Eldon, III, Barto; David Dean McClanahan, Harleysville, both of Pa.

[73] Assignee: Steelcase Inc., Grand Rapids, Mich.

[21] Appl. No.: 367,802

[22] Filed: Dec. 30, 1994

[51] Int. Cl.[6] ..... E04B 2/76

[52] U.S. Cl. ..... 52/220.7; 52/36.1; 52/36.6; 52/239

[58] Field of Search ..... 52/220.7, 238.1, 52/239, 242, 36.1, 36.4, 36.5, 36.6, 126.3, 126.4

[56] References Cited

U.S. PATENT DOCUMENTS

| | | | |
|---|---|---|---|
| 1,724,821 | 8/1929 | Bonnsack | 52/238.1 |
| 1,876,528 | 9/1932 | Walters . | |
| 1,959,135 | 5/1934 | Miller . | |
| 1,990,259 | 2/1935 | Watters | 52/242 |
| 2,121,213 | 6/1938 | Small . | |
| 2,232,510 | 2/1941 | Buckham . | |
| 3,001,615 | 9/1961 | Ries . | |
| 3,045,784 | 7/1962 | Hasekamp . | |
| 3,065,575 | 11/1962 | Ray . | |
| 3,090,164 | 5/1963 | Nelsson . | |
| 3,101,817 | 8/1963 | Radek . | |
| 3,135,026 | 6/1964 | Fridolph . | |
| 3,180,459 | 4/1965 | Liskey, Jr. . | |
| 3,195,698 | 7/1965 | Codrea . | |
| 3,290,846 | 12/1966 | Mader et al. . | |
| 3,370,391 | 2/1968 | Dupuis et al. . | |
| 3,378,977 | 4/1968 | Vervloet | 52/238.1 X |

(List continued on next page.)

FOREIGN PATENT DOCUMENTS

| | | | |
|---|---|---|---|
| 581818 | 3/1989 | Australia . | |
| 1055464 | 2/1954 | France . | |
| 8112517 | 12/1982 | France . | |
| 714002 | 8/1954 | United Kingdom . | |
| 1098851 | 1/1968 | United Kingdom . | |
| 1600990 | 10/1981 | United Kingdom . | |
| 2212186 | 7/1989 | United Kingdom | 52/242 |

OTHER PUBLICATIONS

*Progetto 25.90* by Unifor, Inc., U.S.A., Long Island City, New York, (5 pages), date unknown—prior to Jan. 1, 1991.

*Panneli PL* by Unifor, Inc., U.S.A. Long Island City, New York, (35 pages), date unknown—prior to filing date of present application.

*Knoll International -6 Power Panel* by Knoll International, Inc., (16 pages), prior to Aug., 1990.

Teknion, Office Furniture Systems, 11 pages.

Teknion, Price List Apr. 1983, 32 pages.

Teknion, "3 Reasons Why Teknion Could Change Your Mind About Office Furniture Systems." 17 pages.

*Primary Examiner*—Michael Safavi

*Attorney, Agent, or Firm*—Price, Heneveld, Cooper, DeWitt & Litton

[57] ABSTRACT

A freestanding portable partition panel and related system are provided for open office spaces and the like. Each panel includes a skeleton-like frame having two vertical uprights positioned adjacent opposite side edges thereof. A foot extends downwardly from the bottom of the frame to abuttingly support the panel freestanding on a floor surface. Two pairs of horizontal stringers are attached to the outer faces of the uprights in a vertically spaced apart relationship to rigidly interconnect the same, and define therebetween two horizontal raceway cavities which open to the opposite side faces of the frame, and extend continuously between the opposite side edges thereof. Hence, when like panels are interconnected side-by-side, the open ends of adjacent raceway cavities are aligned and communicate. Cover panels enclose at least those portions of the frame side faces disposed between the stringers, and are detachably mounted thereon to provide ready access to the raceway cavities and permit lay-in wiring therealong. The upper ends of the vertical uprights have upwardly extending arms which define yoke shaped receptacles for receiving drop-in wiring.

75 Claims, 8 Drawing Sheets

U.S. PATENT DOCUMENTS 3,391,795 7/1968 Finlayson .
3,412,515 11/1968 Finon .
3,425,568 2/1969 Albright .
3,500,894 3/1970 Pofferi .
3,514,794 6/1970 Pofferi .
3,561,182 2/1971 Madl, Jr. .
3,571,987 3/1971 Anderson .
3,686,805 8/1972 Pofferi .
3,745,732 7/1973 Pritchard et al. .
3,958,386 5/1976 Pollock .
4,121,645 10/1978 Behr .
4,204,375 5/1980 Good .
4,224,769 9/1980 Ball et al. .
4,255,611 3/1981 Propst et al. .
4,391,069 7/1983 Vermillion .
4,391,073 7/1983 Mollenkopf et al. ..... 52/239 X
4,535,577 8/1985 Tenser et al. .
4,567,698 2/1986 Morrison .
4,567,699 2/1986 McClellan .
4,571,906 2/1986 Ashton .
4,578,914 4/1986 Staples ..... 52/238.1 X
4,625,483 12/1986 Zacky et al. .
4,631,881 12/1986 Charman .
4,646,211 2/1987 Gallant et al. .
4,651,484 3/1987 Rutkowski .
4,660,339 4/1987 Paz .
4,685,255 8/1987 Kelley .
4,712,336 12/1987 Backer .
4,716,699 1/1988 Crossman et al. .
4,730,740 3/1988 Winter et al. .
4,771,583 9/1988 Ball et al. .
4,795,355 1/1989 Dorn et al. .
4,828,005 5/1989 Notley .
4,833,848 5/1989 Guerin .
4,837,988 6/1989 Menchetti et al. .
4,841,699 6/1989 Wilson et al. .
4,862,659 9/1989 Wilson et al. .
4,876,835 10/1989 Kelley et al. .
4,905,428 3/1990 Sykes .
4,918,886 4/1990 Benoit et al. ..... 52/242
4,932,177 6/1990 Hinden .
4,942,713 7/1990 Jackson .
4,942,805 7/1990 Hellwig et al. .
4,944,122 7/1990 Wendt .
4,991,368 2/1991 Amstutz .
5,025,603 6/1991 Johnson .
5,038,539 8/1991 Kelley et al. .
5,054,255 10/1991 Maninfior .
5,062,246 11/1991 Sykes .
5,086,597 2/1992 Kelley et al. .
5,094,053 3/1992 Militzer .
5,117,599 6/1992 Voss .
5,134,826 8/1992 La Roche et al. .
5,142,832 9/1992 Branham, Sr. et al. .
5,155,955 10/1992 Ball et al. .
5,175,969 1/1993 Knauf et al. ..... 52/220.7 X
5,177,917 1/1993 del Castillo Von Haucke ..... 52/220.7
5,184,441 2/1993 Balfanz, Jr. .
5,187,908 2/1993 Losensky .
5,203,132 4/1993 Smolik ..... 52/242
5,209,035 5/1993 Hodges et al. .
5,214,889 6/1993 Nienhuis .
5,214,890 6/1993 Levitan et al. .
5,241,796 9/1993 Hellwig et al. .
5,277,005 1/1994 Hellwig et al. .
5,277,007 1/1994 Hellwig et al. .
5,287,666 2/1994 Frascaroli et al. .
5,309,686 5/1994 Underwood et al. .
5,341,615 8/1994 Hodges et al. .
5,377,461 1/1995 DeGroda et al. ..... 52/238.1 X
5,377,466 1/1995 Insalaco et al. .
5,394,658 3/1995 Schreiner et al. .
5,394,668 3/1995 Lim .
5,406,760 4/1995 Edwards .

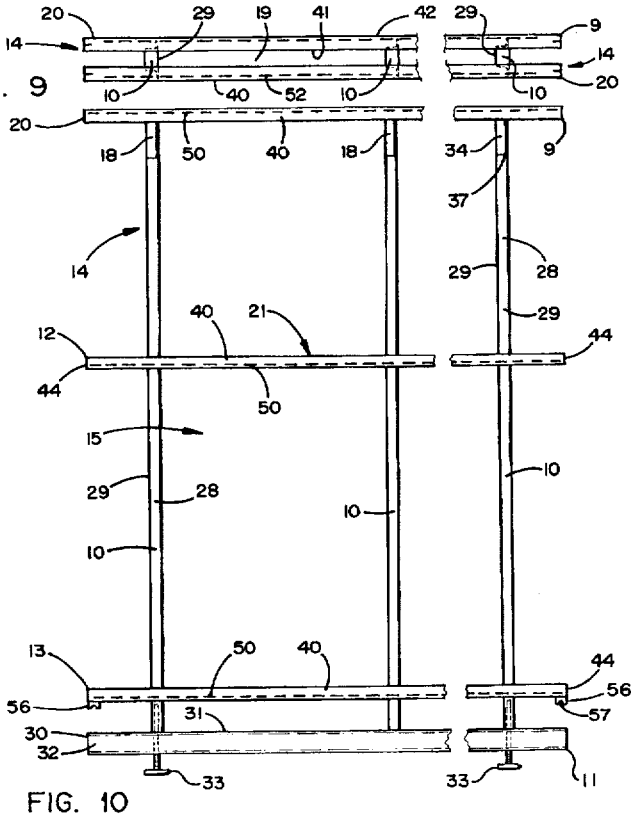
FIG. 9
FIG. 10
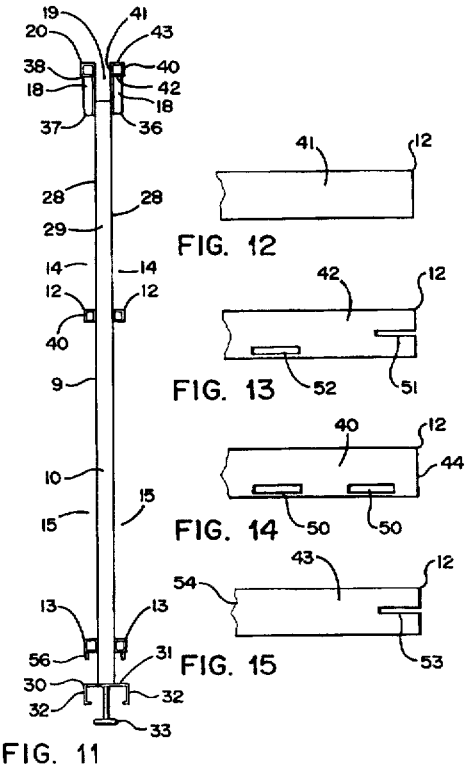
FIG. 11
FIG. 12
FIG. 13
FIG. 14
FIG. 15

PARTITION SYSTEM

CROSS-REFERENCES TO RELATED APPLICATIONS

The present application is related to commonly assigned, co-pending U.S. patent application Ser. No. 08/367,804, filed Dec. 30, 1994, entitled INTEGRATED PREFABRICATED FURNITURE SYSTEM FOR FITTING-OUT OPEN PLAN BUILDING SPACES, which is hereby incorporated herein by reference.

BACKGROUND OF THE INVENTION

The present invention relates to partition arrangements for open office spaces and the like, and in particular to a freestanding portable panel and related partition system.

Portable partition systems for open office spaces, and other similar settings, are well known in the art. Individual partition panels are interconnected in different configurations to form separate offices, workstations or work settings. The partition panels are extremely durable, and can be readily disassembled and reassembled into alternative configurations to meet the ever-changing needs of the user. Examples of such partition systems are provided in U.S. Pat. Nos. 3,822,146; 3,831,330; and 4,144,924, which are owned by Steelcase Inc., the assignee of the present application.

Most such partition panels are capable of carrying wires in some fashion, so as to provide electrical power at the various workstations for computers, typewriters, dictating equipment, task lighting, and other electrical appliances. These partition panels are also typically capable of routing cabling for telephones, computers, signaling, etc. to the individual workstations. Examples of such panel wiring systems are disclosed in U.S. Pat. Nos. 4,429,934; 4,060,294; 4,228,834; and 4,382,648. Wireways and/or raceways are normally provided within the interiors of the panels to carry the utilities throughout the panel system.

The space available for utility raceways in many such panel systems is rather limited. This is particularly true with respect to several of the older style partition panel systems. The advent of computerized workstations, with sophisticated communication systems, and other electronic support equipment has greatly increased the need for partition panels to carry more power and cabling throughout the panel system.

The finishing or fitting-out of building spaces for offices, medical treatment facilities, and other similar environments has become a very important aspect of effective space planning and layout. Work patterns, technology, and business organizations are constantly evolving and changing. The building space users require products which facilitate change at lower costs. Space planning is no longer a static problem. Changing technology and changing work processes demand that a design and installation be able to support and anticipate change.

There is presently an oversupply of office space and furniture systems which do not properly respond to or support change. Many older buildings do not have adequate utility capabilities, and the cost of conventional renovations or improvements often renders the same impractical. Even relatively new buildings can be quickly rendered obsolete by the fast paced changes in modern technology.

Consequently, a fully integrated prefabricated furnishing system has been developed to finish or fit-out both new and existing open plan building spaces, as disclosed in commonly assigned, co-pending U.S. patent application Ser. No. 08/367,806, filed Dec. 30, 1994, entitled INTEGRATED PREFABRICATED FURNISHING SYSTEM FOR FITTING-OUT OPEN PLAN BUILDING SPACE, which has been incorporated herein by reference. One requirement of this integrated furnishing system is a freestanding portable partition system that has enhanced utility carrying capabilities.

SUMMARY OF THE INVENTION

One aspect of the present invention is a freestanding portable partition panel and related system for open office spaces and the like. Each panel includes a skeleton-like frame having two vertical uprights positioned adjacent opposite side edges thereof. A foot extends downwardly from the bottom of the frame to abutting support the panel freestanding on a floor surface. Two pairs of horizontal stringers are attached to the outer faces of the uprights in a vertically spaced apart relationship to rigidly interconnect the same, and define therebetween two horizontal raceway cavities which open to the opposite side faces of the frame, and extend continuously between the opposite side edges thereof, such that when like panels are interconnected side-by-side, the open ends of adjacent raceway cavities are aligned and communicate. Cover panels enclose at least those portions of the frame side faces disposed between the stringers, and are detachably mounted thereon to provide ready access to the raceway cavities and permit lay-in wiring therealong.

Preferably, the stringers are spaced laterally apart by the uprights to define a vertical raceway cavity between the two horizontal raceway cavities. Each vertical upright includes a pair of arms extending upwardly from upper ends thereof to define yoke shaped receptacles for receiving drop-in wiring therein. A third pair of horizontal stringers may be attached to the upper ends of the arms to extend generally parallel and coplanar with the first and second pairs of stringers. The vertical uprights and horizontal stringers may have a substantially identical tubular construction to facilitate fabrication.

Another aspect of the present invention is a freestanding portable partition panel and related system for open office spaces and the like. Each panel includes a skeleton-like frame having two vertical uprights positioned adjacent opposite side edges thereof, with a pair of arms attached to the outer faces of the uprights and extending upwardly therefrom to define yoke shaped receptacles for receiving drop-in wiring. A foot extends downwardly from the bottom of the frame to abuttingly support the panel freestanding on a floor surface. A first pair of horizontal stringers is attached to the upper ends of the arms, and a second pair of horizontal stringers is attached to the opposite outer faces of the vertical upright in a vertically spaced apart relationship with the first pair of horizontal stringers to rigidly interconnect the same. Cover panels are connected with the opposite sides of the frames to enclose the same.

The principal objects of the present invention are to provide a freestanding portable partition panel and related system that has enhanced utility carrying capabilities. The partition panel enables developers and businesses to facilitate change and create lower cost environments to support new work processes in even outdated and/or underutilized buildings. The partition system allows user control over environment, so as to create healthier work areas, which reduces stress and absenteeism. The partition system also provides improve utility distribution at lower first time cost, as well as greater flexibility in utilities with lower life cycle costs. The partition system provides a new range of design options through the introduction of a horizontal datum, and allows a full range of levels of privacy. The partition system is efficient to use, economical to manufacture, capable of a long operating life, and particularly well adapted for the purposed use.

These and other advantages of the invention will be further understood and appreciated by those skilled in the art by reference to the following written specification, claims, and appended drawings.

BRIEF DESCRIPTION OF THE DRAWINGS

FIG. 9 is a fragmentary, top plan view of the base panel frame.

FIG. 10 is a fragmentary, front elevational view of the base panel frame.

FIG. 11 is a side elevational view of the base panel frame.

FIG. 12 is a fragmentary, top plan view of a horizontal stringer portion of the base panel frame.

FIG. 13 is a fragmentary, bottom plan view of the horizontal stringer shown in FIG. 12.

FIG. 14 is a fragmentary, front elevational view of the stringer shown in FIGS. 12 and 13.

FIG. 15 is a fragmentary, rear elevational view of the horizontal stringer shown in FIG. 12–14.

FIG. **24*a*** is a fragmentary, top panel view of a pair of partition panels interconnected in an in-line or side-by-side relationship.

Figures 24A, 24B, 25, 26, 27, 28, 29, 29A:
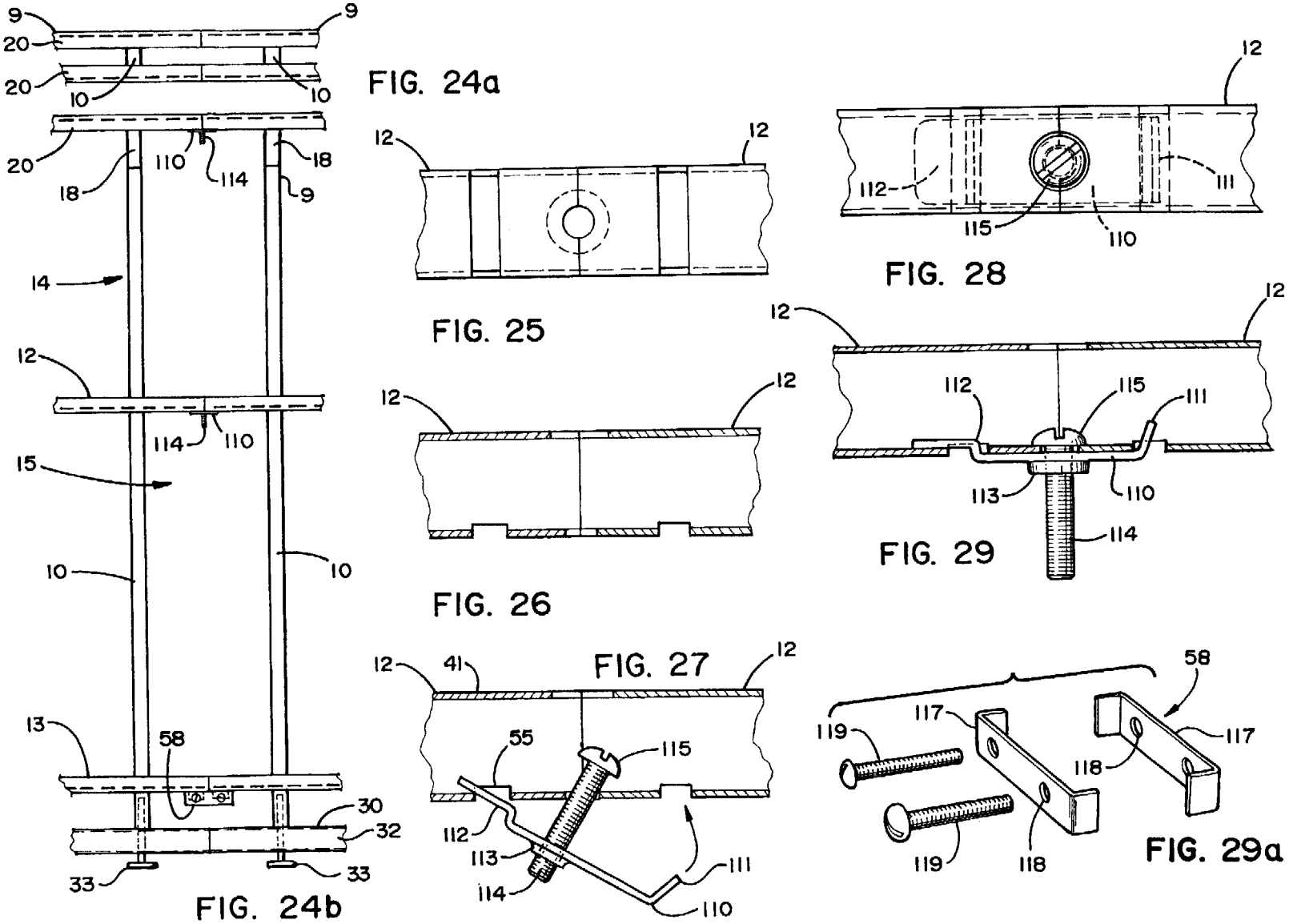

FIG. **24*b* is a fragmentary, front elevational view of the in-line partition panels shown in FIG. 24*a***.

FIG. 25 is an enlarged, fragmentary top plan view of adjacent horizontal stringers in the in-line partition panels shown in FIGS. **24*a*–24*b***.

FIG. 26 is a vertical cross-sectional view of the adjacent horizontal stringers in the in-line panels of FIG. 25, shown before installation of a panel-to-panel clip.

FIG. 27 is a vertical cross-sectional view of the in-line horizontal stringers shown in FIG. 27, with a panel-to-panel clip shown partially installed therein.

FIG. 28 is a fragmentary, top plan view of the in-line horizontal stringers shown in FIG. 27, with the panel-to-panel connector clip shown fully installed.

FIG. 29 is a fragmentary, vertical cross-sectional view of the in-line horizontal stringers shown in FIG. 27, with the panel-to-panel connector clip shown fully installed.

FIG. **29*a*** is a perspective view of a panel-to-panel base clamp.

Figure 30:
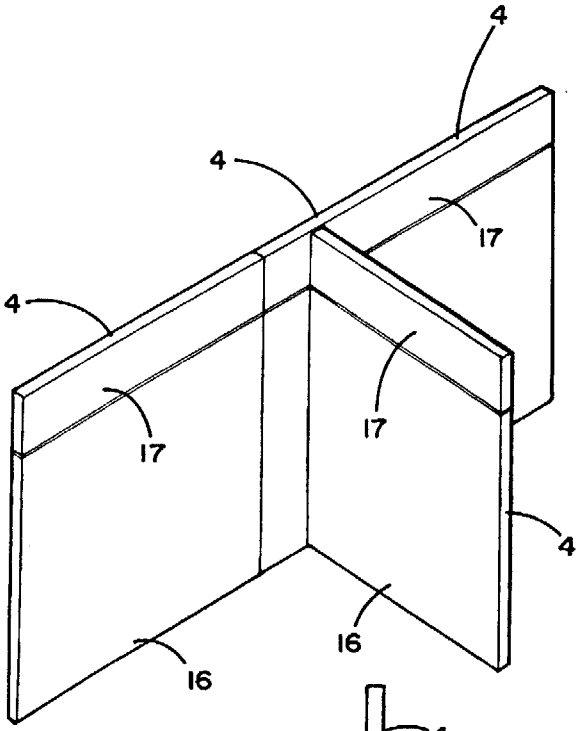

FIG. 30 is a perspective view of three of the partition panels, of which two are interconnected in-line, and one is interconnected at an angle or branched to the in-line panels.

Figure 31:
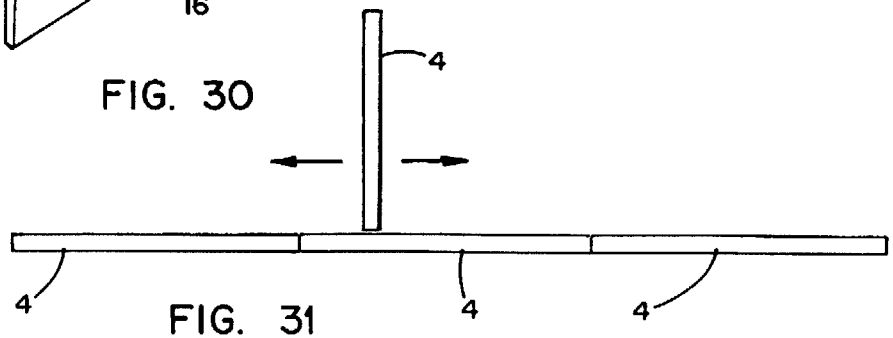

FIG. 31 is a partially schematic, top plan view of the panels shown in FIG. 30, wherein the branched panel can be interconnect anywhere along the in-line panels.

Figure 32:
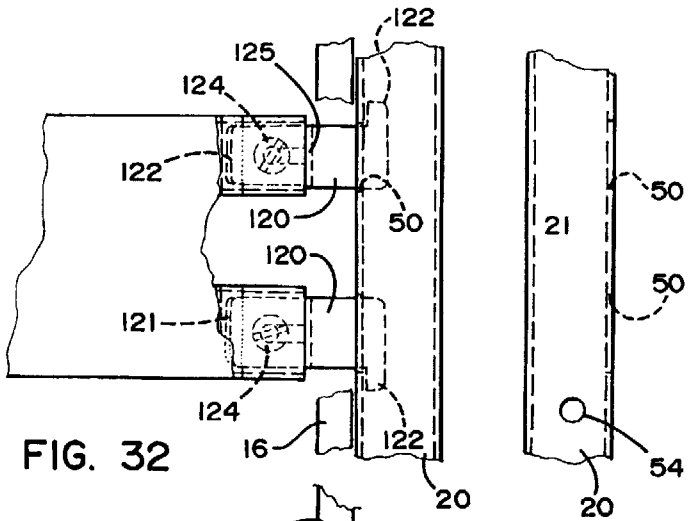

FIG. 32 is a fragmentary, top-plan view of the panels shown in FIGS. 30–31, wherein portions thereof have been broken away to reveal internal construction.

Figure 33:
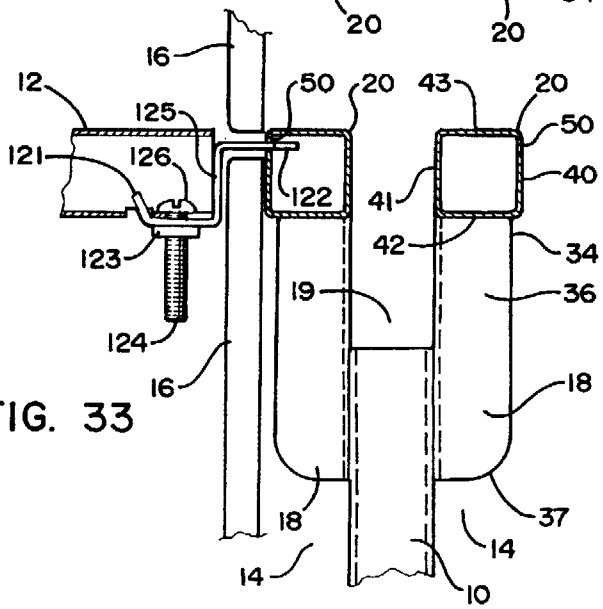

FIG. 33 is a fragmentary, vertical cross-sectional view of the panels shown FIG. 32.

DETAILED DESCRIPTION OF THE PREFERRED EMBODIMENTS

Figure 1:
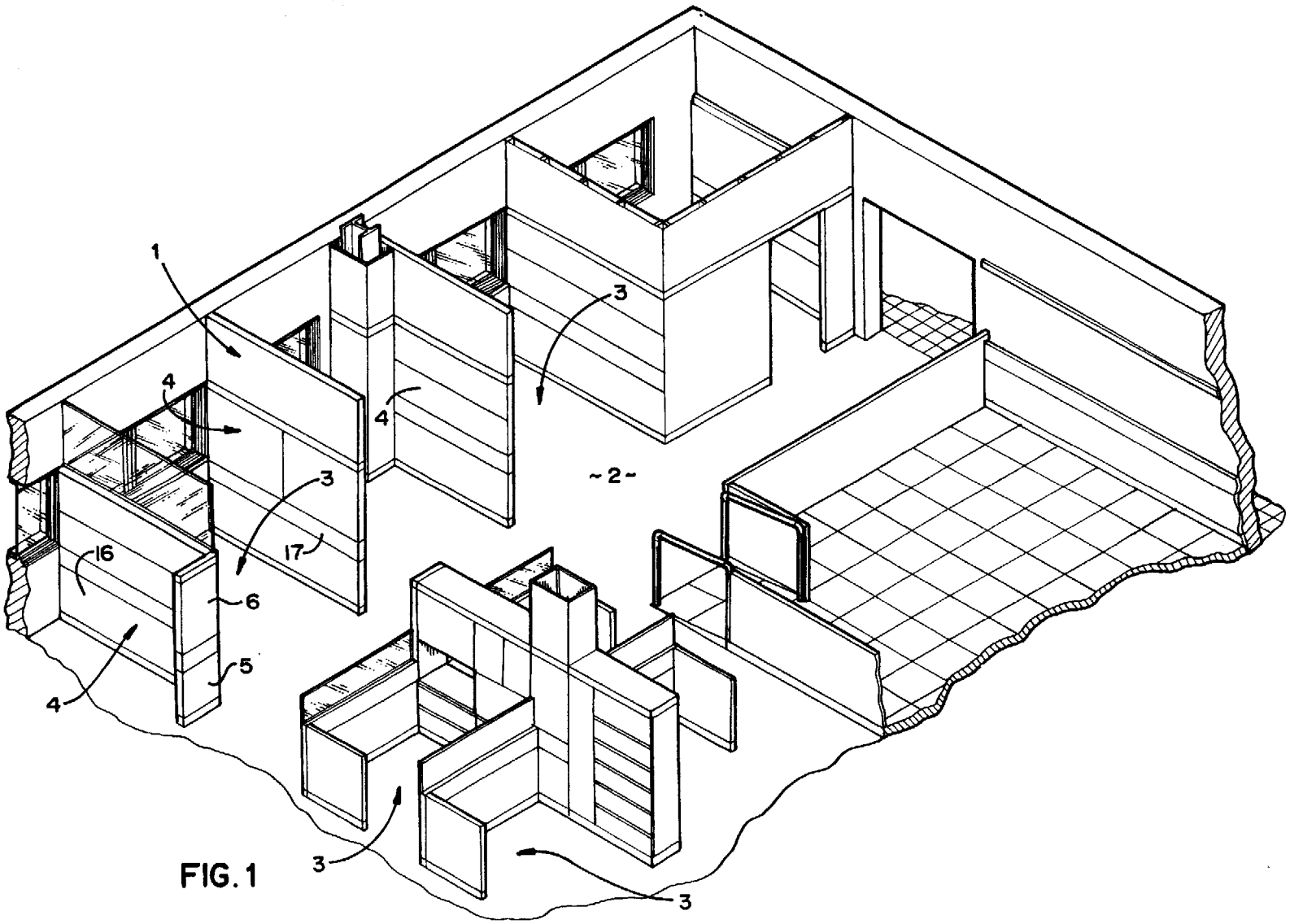
FIG. 1 is a perspective view of an integrated prefabricated furniture system, which includes a partition panel and related system embodying the present invention.
Figure 2:
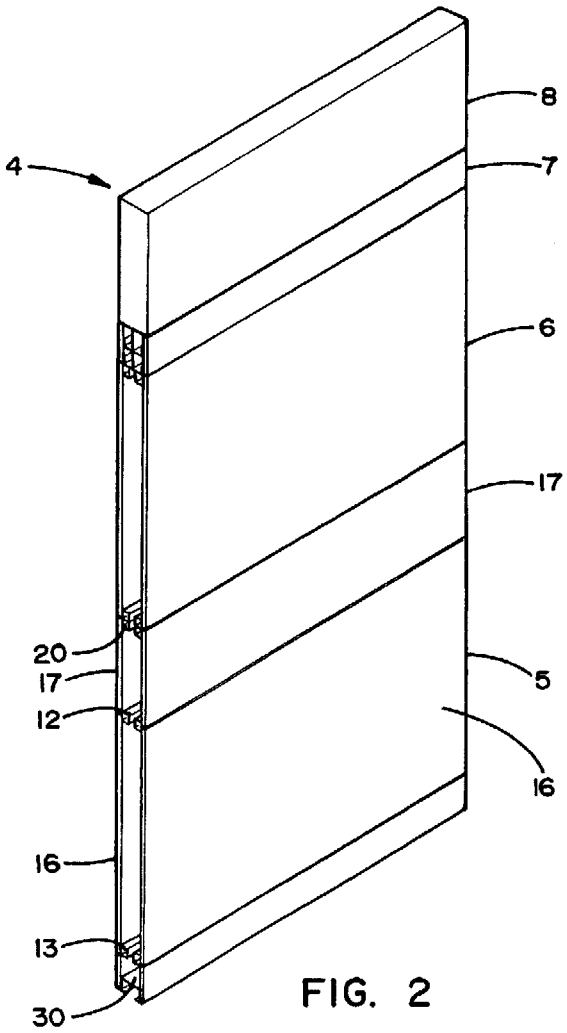
FIG. 2 is a perspective view of a partition panel embodying the present invention.

For purposes of description herein, the terms "upper," "lower," "right," "left," "rear," "front," "vertical," "horizontal," and derivatives thereof shall relate the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specifications are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
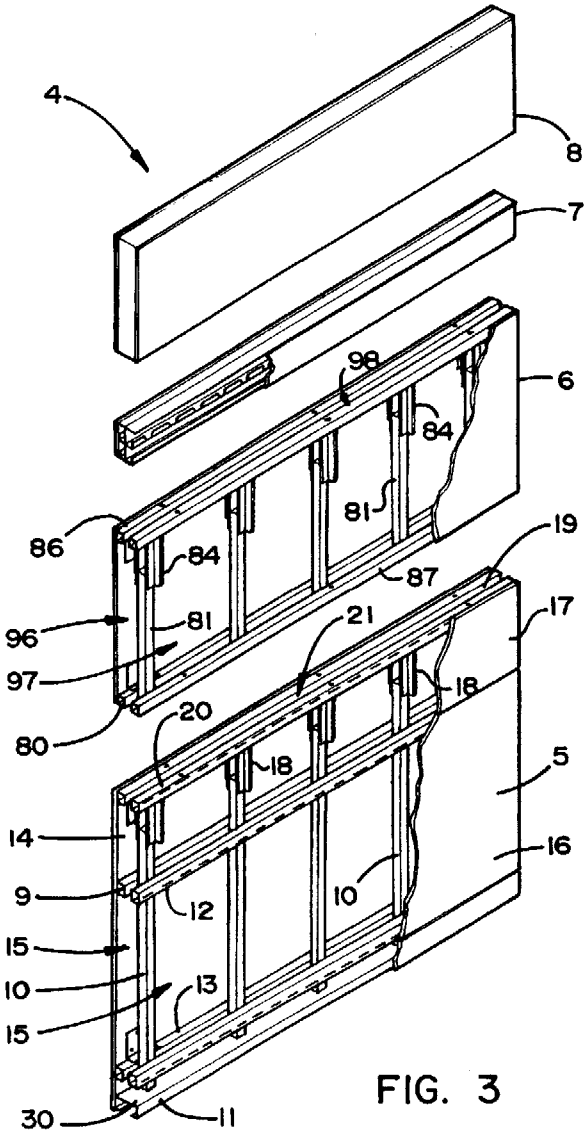
FIG. 3 is an exploded, perspective view of the partition panel, wherein portions thereof have been broken away to reveal internal construction.

The reference numeral 1 (FIG. 1), generally designates a freestanding portable partition system that is designed for use in conjunction with open office spaces 2, and other similar environments to form a plurality of work settings or workstations 3. Partition system 1 includes a plurality of similar modular panels 4 (FIGS. 2 and 3), which are interconnected so as to define the desired workstations 3. One such partition panel 4 is illustrated in FIGS. 2 and 3, and includes a base panel 5, a stacker panel 6, expressway raceway 7, and a transom 8, which are stacked vertically on top of one another.

The base panel 5 (FIG. 3) includes a skeleton-like internal frame 9 having at least two vertical uprights 10 positioned adjacent opposite side edge thereof. A foot 11 extends downwardly from the bottom of frame 9 to abuttingly support base panel 5 on a floor surface. Two pairs of horizontal stringers 12 and 13 are attached to the outer faces of uprights 10 in a vertically spaced apart relationship to rigidly interconnect the same, and define therebetween two horizontal raceway cavities 14 and 15, which open to the opposite side faces of frame 9, and extend continuously between the opposite side edges thereof, such that when like base panels 5 are interconnected side-by-side, the open ends of adjacent raceway cavities 14 and 15 are aligned and communicate. Cover panels 16 enclosed at least those portions of the frame side faces disposed between stringers 12 and 13, and are detachably mounted thereon to provide ready access to the raceway cavities 14 and 15, and permit lay-in wiring therealong.

Each of the illustrated vertical upright 10 (FIGS. 9–11) includes a pair of arms 18, which are attached to the outer faces thereof, and extend upwardly from upper ends thereof to define yoke shaped receptacles 19 for receiving drop-in wiring therein. A third pair of horizontal stringers 20 are attached to the upper ends of arms 18, and extend generally parallel and coplanar with associated stringers 12 and 13. Each pair of stringers 12, 13, and 20 is spaced mutually laterally apart by the associated uprights 10, so as to define a vertical raceway cavity 21 positioned intermediate the two horizontal raceway cavities 14 and 15.

The illustrated base panel frame 9 (FIGS. 9–15) has an open, skeleton-like construction, that is preferably provided in a variety of different widths to accommodate various applications. However, in each illustrated embodiment of base panel 5, the horizontal stringers 12, 13, and 20 are substantially longer than the vertical uprights 10, such that each base panel 5 has a horizontally elongated elevational shape or datum. The base panel frame 9 illustrated in FIG. 3 includes a total of five vertical uprights 10, each of which has a substantially identical, square tubular construction, comprising opposite side faces 28 (FIGS. 9–15) oriented toward the opposite sides of base panel 5, and opposite end faces 29 oriented toward the opposite end edges of base panel 5. The lower ends of vertical uprights 10 are attached to a C-shaped base channel 30, which defines the panel foot 11, and includes a top web 31, and opposite side flanges 32. A pair of threaded glides or feet 33 extend through the web 31 of base channel 30 into the bottom ends of outermost uprights 10 to provide vertical adjustability at the opposite sides or ends of base panel 5. The illustrated arms 18 have a square tubular construction substantially identical to that of vertical uprights 10, and include opposite side faces 34, as well as opposite end faces 36. The lower ends 37 of arms 18 are fixedly attached fixedly to the side faces 28 of vertical uprights 10 adjacent the upper ends thereof, and extend vertically upwardly therefrom a distance of approximately two to four inches in vertical alignment with the associated upright 10, thereby defining the yoke shaped receptacles 19 for drop-in wiring.

In the illustrated example of base panel frame 9, each of the horizontal stringers 12, 13, and 20 has a square tubular construction that is substantially identical with that of vertical uprights 10, and includes opposite faces 40–43, and opposite ends 44. Horizontal stringers 12, 13, and 20 have a length substantially identical with that of base panel 30, and are arranged in a mutually parallel, vertically spaced apart relationship. In one working example of the present invention, stringers 13 are located approximately four inches above floor height, while stringers 12 are located approximately 30 inches above floor height. Horizontal stringers 12 and 13 have their inward faces 41 attached to the outer side faces 28 of vertical uprights 10 by means such as welding or the like. Stringers 20 have their bottom faces 43 rigidly attached to the upper ends 38 of arms 18, and in one working embodiment of the present invention, the same are positioned approximately 40 inches above floor height. Each pair of stringers 12, 13, and 20 is mutually horizontally aligned on opposite sides of its associated vertical uprights 10. The stringers 12, 13, and 20 on the opposite sides of vertical uprights 10 are horizontally coplanar, and facilitate the mounting of cover panel 16 and 17 thereon.

With reference to FIGS. 12–15, the illustrated horizontal stringers 12, 13, and 20 are slotted to permit like panels 4 to be interconnected and support various accessories thereon, as described in greater detail hereinafter. With reference to the upper stringers 20, the rear or inward face 41 is full as shown in FIG. 12, while the opposite front face 40 (FIG. 14) includes a series of horizontal slots 50, which extend continuously between opposite ends 44 thereof in a regular pattern. The bottom face 42 of horizontal stringers 12 includes an end slot 51 and a series of windows 52, as shown in FIG. 13, while the opposite top face 43 has an end slot 53 and stacker apertures 54, as shown in FIG. 15. In the base panel frame 9 shown in FIGS. 10 and 11, a pair of clamp brackets 56 are mounted to the opposite ends of each lower stringer 13, and project downwardly therefrom. Each clamp bracket 56 includes a semi-circular notch 57 to receive an associated panel-to-panel clamp 58 (FIGS. **24*b* and 29*a***), as described below.

Figures 5, 6, 7, 8:
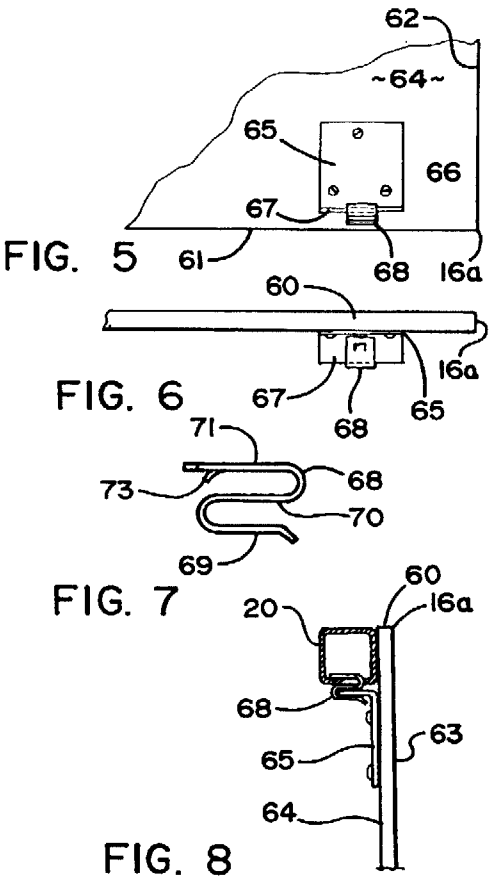
FIG. 5 is a fragmentary, rear elevational view of the cover panel, showing a mounting clip thereon.
FIG. 6 is a fragmentary, top plan view of the cover panel shown in FIG. 5.
FIG. 7 is a side elevational view of the mounting clip.
FIG. 8 is a fragmentary, vertical cross-sectional view of a cover panel shown mounted on the base panel frame.
Figure 4:
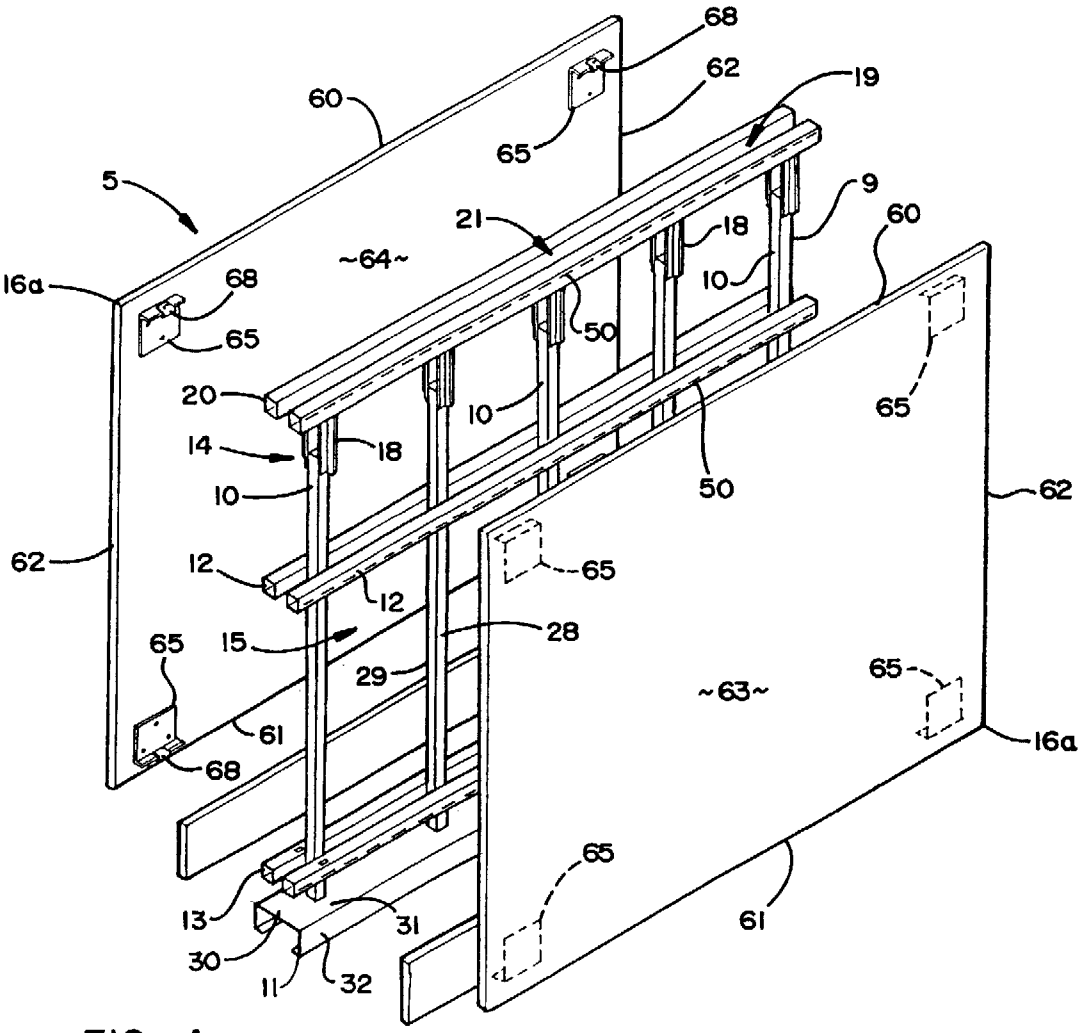
FIG. 4 is an exploded, perspective view of a base panel portion of the partition panel, having a frame with removable cover panels.

The illustrated cover panels 16 and 17 (FIGS. 4–8) for base panel 5 have a substantially similar construction, each with a rectangular front elevational shape that includes a top edge 60, bottom edge 61, opposite side edges 62, and opposite faces 63 and 64. The front faces 63 of cover panels 16 and 17 are preferably finished, so as to provide and aesthetically pleasing appearance, and may include upholstery, paint, wood veneer, as well as specialty surfaces, such as white board, chalk board, and the like. Each cover panel 16 and 17 has a width generally commensurated with that of its associated panel frame 9, and a height generally commensurated with the vertical spacing between an associated pair of horizontal stringers 12, 13, and 20. For example, in the base panel 5 illustrated in FIG. 3, cover panel 16 extends between medial portions of stringers 12 and 13, while cover panel 17 extends between medial portions of stringers 12 and 20. A full height cover **16*a* is shown in FIG. 4, and extends between medial portions of stringers 13 and 20 to enclose the entire face of base panel frame 9. L-shaped brackets 65 are attached to the interior faces 64 of cover panel 16 and 17 adjacent opposite corners thereof by fasteners 66, or another suitable attachment system, such as adhesive, etc. Each of the brackets 65 has an outwardly extending flange 67, which receives a spring type mounting clip 68 thereon. As shown in FIG. 7, each clip 68 has a generally S-shaped side elevational configuration, comprising three parallel leg portions 69–71. The outer leg 69 and center leg 70 form a U-shaped area that snaps onto the flange 67 of bracket 65, as shown in FIGS. 5 and 6. The outer leg 71 includes a barb 73 that engages the window 52 on the associated stringers 12, 13, and 20. Cover panels 16 and 17 are pushed inwardly onto frames 9, so that clips 68 engage brackets 65 to detachably mount the cover panels in the fashion shown in FIG. 8**.

In use, the cover panel 16, 17, and **17*a* are installed on an associated base frame 9 in the following fashion. The cover panels 16, 17, and 17*a* are first selected from a group of different widths and heights to match the panel configuration desired. The selected cover panels 16, 17, and 17*a* are then converged on to the opposite sides of the associated frame 19, with clips 68 engaging the aligned stringers 12, 13, and 20. Cover panels 16, 17, and 17*a* are then urged inwardly against the associated panel frame 9, so that the barb 73 on clips 68 engage aligned windows 52 in horizontal stringers 12, 13, and 20 to securely, yet removably mount the same in place. Cover panels 16, 17, and 17***a* are thereby positioned against or adjacent the outer faces 40 of horizontal stringers 12, 13, and 20, thereby enclosing or completing the horizontal raceway cavities 14 and 15, each of which has a vertically elongated shape when viewed in end elevation. The two horizontal raceway cavities 14 dispose between horizontal stringers 12 and 20 are located adjacent work surface height, and define beltway raceway cavities. The two horizontal raceway cavities 15 disposed between horizontal stringers 12 and 13 are located adjacent to the panel base, and define lower raceway cavities.

The illustrated stacker panel 6 (FIGS. 3 and 16) has a construction substantially similar to previously described base panel 5, except that it does not have a foot 11 or an intermediate pair of stringers 13. Stacker panel 6 also comes in a variety of different widths, as well as various heights, and mounts directly on top of an associated base panel 5, as discussed in greater detail below.

Figure 16:
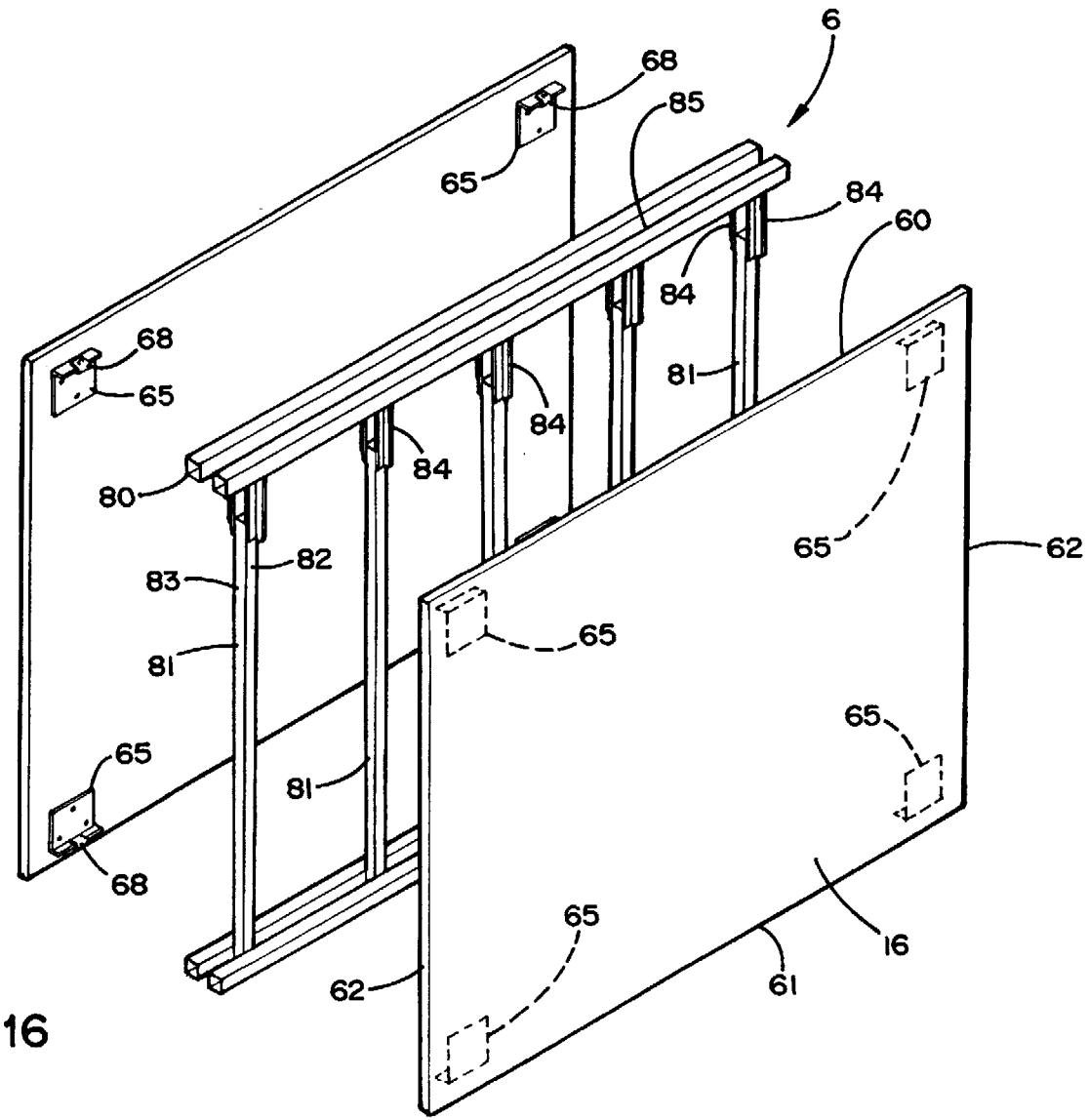
FIG. 16 is an exploded, perspective view of a stacker panel portion of the partition panel, having a frame with removable cover panels.
Figures 17, 18, 19, 20, 21, 22, 23:
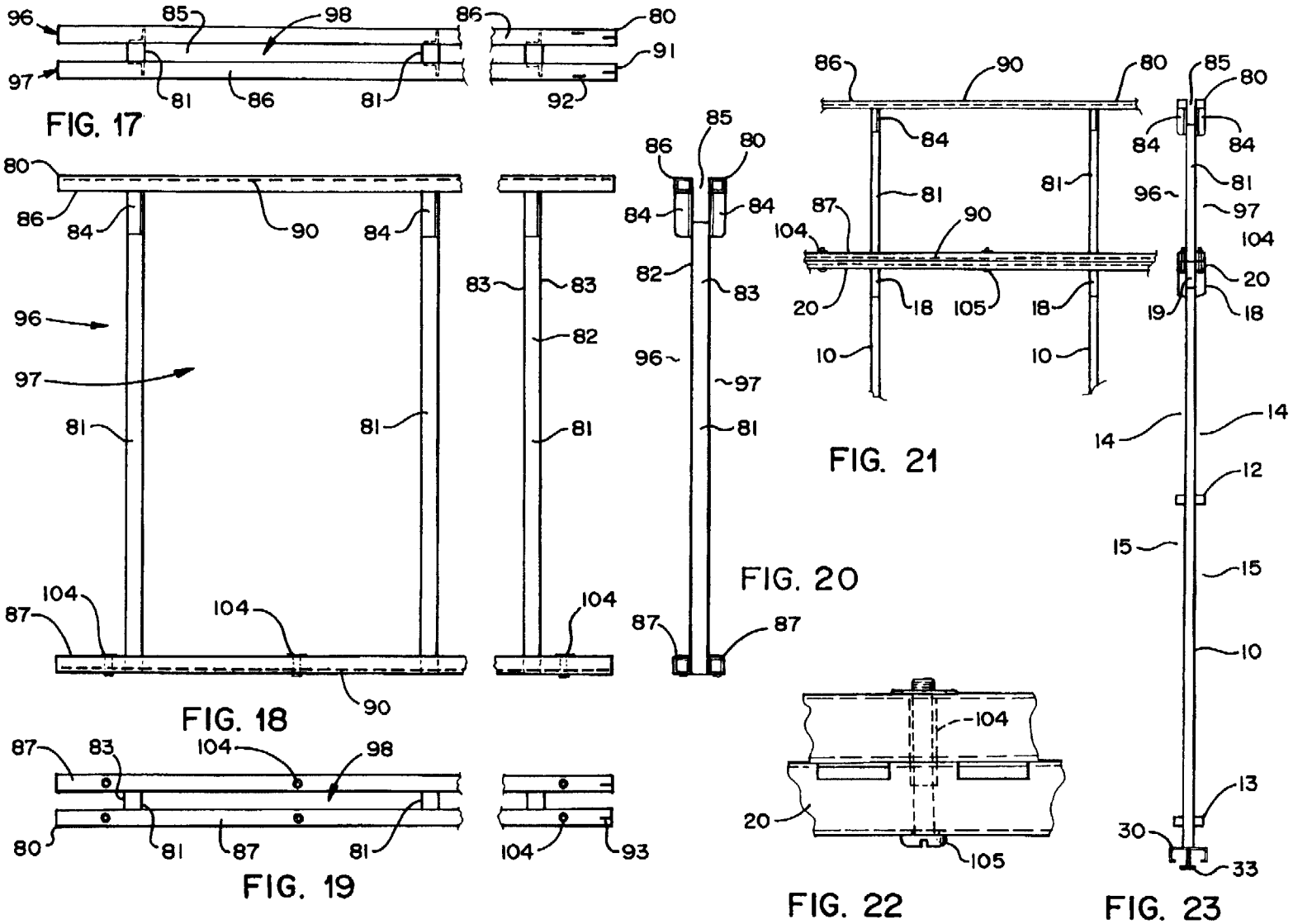
FIG. 17 is a fragmentary, top plan view of the stacker panel frame.
FIG. 18 is a fragmentary, front elevational view of the stacker panel frame.
FIG. 19 is a fragmentary, bottom plan view of the stacker panel frame.
FIG. 20 is a side elevationally view of the stacker panel frame.
FIG. 21 is a fragmentary, front elevational view of a stacker panel frame mounted on a base panel frame.
FIG. 22 is an enlarge, fragmentary front elevational view of a connection between the stacker panel frame and base frame shown in FIG. 21.
FIG. 23 is a side elevational view of the interconnected base frame and stacker panel frame shown in FIG. 21.

The stacker panel 6 shown in FIG. 16 has a skeleton-like frame 80, comprising five vertical uprights 81, which are spaced generally regularly along the width of stacker panel 6. Each of the vertical uprights 81 is constructed from square tubing, substantially identical to that of base panel uprights 10, and includes opposite pairs of faces 82 and 83. Arms 84 (FIGS. 17–20), similar to base panel arms 18, are attached to the opposite side faces 82 of each stacker panel upright 81, and extend upwardly from upper ends thereof to define Y-shaped receptacles 85 for drop-in wiring. A first pair of horizontal stringers 86 is attached to the upper ends of arms 84, and a second pair of horizontal stringers 87 is attached to the side faces 82 of uprights 81 adjacent the lower ends thereof. Both pairs of stringers 86 and 87 are constructed from square tubing substantially similar to vertical uprights 81, as well as the stringers 12, 13, and 20 associated with base panel frame 9.

Each of the stringers 86 and 87 associated with stacker panel frame 80 has a slotted configuration similar to the stringers 12, 13, and 20 of base panel frame 9, and includes a series of horizontal slots 90 along the forward faces, end slots 91 and windows 92 on the top faces, and end slots 93 on the bottom faces.

The stacker panel 6 illustrated in FIG. 16 has a height substantially equal to the height of the lower panel 16 of the base panel 5 illustrated in FIG. 3, such that cover panel 16 can be mounted directly on the opposite sides of stacker panel frame 80 in the fashion described above with respect to base panel 5. The interior spaces formed between stacker frame uprights 81 and their associated stringers 86 and 87 define horizontal raceway cavities 96 and 97, which open toward the opposite faces of stacker panel 6. Horizontal raceway cavities 96 and 97 that are substantially similar to the horizontal raceway cavities 14 and 15 associated with base panel 5, and include open ends, which are aligned and communicate with adjacent like stacker panels to route utilities therebetween. Stacker panel 6 also has a vertical raceway cavity 98 (FIG. 17) formed in-between the two horizontal raceway cavities 96 and 97.

As best illustrated in FIGS. 17–23, the lower stringers 87 on stacker panel frame 80 include a plurality of vertically extending threaded sleeves 104 positioned regularly along stringers 87, which facilitate mounting stacker panel 6 on an associated base panel 5. The lower ends of sleeves 104 extend downwardly from the lower surfaces of stringers 87, and form pilots that are closely received and retained in the apertures 54 in the upper surfaces of stringers 12 on base panel 5. Threaded fasteners 105 are inserted upwardly through the apertures 54 in base panel stringers 20, and into the sleeves 104 of stacker panel 6 to securely interconnect the same.

In operation, the height of any given partition panel 4 can be easily varied by selecting the appropriate number and size of base panels 5 and stacker panels 6. In the partition panel 4 illustrated in FIG. 3, a single stacker panel 6 is mounted on top of base panel 5 in the following manner. With all cover panel 16, 17, etc. removed, the selected stacker panel frame 80 is placed on top of the associated base panel frame 9, so that the lower stringers 87 of stacker panel frame 80 rest directly on top of the upper stringers 12 on base panel frame 9. The lower ends of sleeves 104 are inserted into apertures 54 on stringers 12 to squarely orient stacker panel frame 80 on top of base panel frame 9. Fasteners 105 are then inserted through the apertures 54 in the upper stringer 12 of base panel frame 9, and engaged in sleeves 104 to securely connect stacker panel frame 80 on top of base panel frame 9. Cover panels 16, 17, etc. are then positioned over the outer faces of both frames 9 and 80.

With reference to FIGS. 24*a*–29*a*, adjacent partition panels 4 are interconnected in an in-line relationship, or side-by-side in the following manner. Panel-to-panel clips 110 are provided, each having a plate like construction, with an upturned tab 111 at one end, and a Z-shaped tab 112 at the opposite end. A threaded boss 113 is positioned at a medial portion of the clip 110, and is aligned with a mating aperture in which a threaded fastener 114 is received. In the in-line example illustrated in FIGS. 24*a*–29*a*, when like base panel frames 9 are positioned end-to-end, the associated stringers 12, 13, and 20 are aligned, with the opposite ends abutting one another. Any stacker panel frames 80 are similarly positioned end-to-end and aligned. With reference to the illustrated base panel 5, the panel-to-panel clips 110 are used to interconnect the opposite ends of each adjacent pair of horizontal stringers 12 and 20 in the following manner. As shown in FIG. 27, the Z-shaped tab 112 of clip 110 is first inserted into the lower window 55 in one of the adjacent stringers, such as the illustrated stringer 12. The head portion 115 of fastener 114 is positioned between the top and bottom faces 42 and 43 of the adjacent stringers 12. The upturned tab 111 of clip 110 is then inserted into the lower window 55 of the opposite stringer 12, and fastener 114 is then tightened, which may be accomplished by inserting a tool (not shown) through the windows 51 in the top faces 42 of stringers 12. After all fasteners 114 have been tightened, the opposite tabs 111 and 112 on clips 110 positively interconnect the opposite ends of the associated stringers 12. When a pair of base panels 5 are positioned in-line, preferably the ends of each of stringers 12 and 20 are thusly interconnected, thereby requiring four clips 110.

In the example shown in FIG. 24*b*, a panel-to-panel clamp 58 is used to interconnect the adjacent ends of the lower stringers 13. As best shown in FIG. 29*a*, panel-to-panel clamp 58 includes a pair of U-shaped bracket halves 117, each having a pair of apertures 118 through which fasteners 119 are received. As shown in FIG. 24*b*, the two clamp halves 117 are positioned on opposite sides of brackets 56, with fasteners 119 passing through notches 57. When fasteners 119 are tightened the opposite halves 117 of bracket 58 capture the four adjacent brackets 56 therein to securely interconnect the lower stringers 13 end-to-end.

With reference to FIGS. 30–33, partition panels 4 can also be interconnected in a branched or angular configuration in the following fashion. Branching clips or off-module connectors 120 are provided, and have a generally plate shaped construction, which includes a upturned tab 121 at one end and a horizontally oriented hook 122 at the opposite end. A threaded boss 123 is mounted on a lower portion of branching clip 120, and is aligned with a mating aperture in which a threaded fastener 124 is received. Branching clip 120 has a L-shaped center portion 125, which extends along the end 44 of an associated one of the stringers, such as the illustrated stringer 12.

In use, the partition panel 4 can be interconnected to a like partition panel 4 in an angular orientation at locations anywhere along the length of the in-line panels. For instance, in the example illustrated in FIGS. 30 and 31, three panels 4 are shown interconnected in an in-line orientation in the fashion described herein above. A single panel 4 is shown attached at a 90 degree angle to the three in-line panels at a position intermediate the opposite side edges of the center panel 4. It is to be understood that the branched panel 4 can be attached anywhere along the length of the three in-line panels, which greatly facilitates space planning.

A branched panel 4 is mounted in the following manner. A pair of branching clips 120 are selected, and hook ends 122 are inserted into the adjacent slots 50 in stringers 12, 13, and 20 at the location at which the branched panel 4 is to be located. The heads 126 of fasteners 124 are positioned in the hollow interiors of stringers 12. The tab ends 121 of clips 120 are shifted into the lower windows 55 in stringers 12, and fasteners 124 are then tighten to securely interconnect the branched panel 4.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A freestanding portable partition panel for open office spaces and the like, comprising:

a skeleton-like frame, having:

first and second vertical uprights positioned adjacent opposite side edges of said frame with each including outwardly oriented opposite outer faces;

a foot extending downwardly from a bottom portion of said frame to abuttingly support said partition panel freestanding on a floor surface;

first and second pairs of horizontal stringers attached to the opposite outer faces of said vertical uprights in a vertically spaced apart relationship to rigidly interconnect said vertical uprights and define therebetween first and second horizontal raceway cavities which open to opposite side faces of said frame, and extend continuously between the opposite side edges thereof with open ends, such that when like partition panels are interconnected in a side-by-side relationship, the open ends of adjacent raceway cavities are aligned and communicate, at least said first pair of horizontal stringers each including an apertured planar outer face defining a row of horizontally spaced and aligned slots that in turn define several discrete attachment points along a length of said first stringers for adjustably supporting a furniture component such as an "off-module" partition;

first and second cover panels shaped to cover at least those portions of the side faces of said frames disposed between said first and second pairs of horizontal stringers and further shaped to permit horizontal access to said slots; and fasteners detachably mounting said cover panels on the outer faces of said stringers to provide ready access to the raceway cavities and permit lay-in wiring thereal-ong.

2. A partition panel as set forth in claim 1, wherein:

said first and second pairs of stringers are spaced laterally apart by said uprights and define a vertical raceway cavity therebetween disposed intermediate said first and second horizontal raceway cavities.

3. A partition panel as set forth in claim 2, wherein:

said stringers extend horizontally between medial portions of said vertical uprights, whereby said first and second raceway cavities define beltway raceway cavities located adjacent a worksurface height.

4. A partition panel as set forth in claim 3, wherein:

said frame includes a pair of arms connected with the outer faces of each of said vertical uprights and extending upwardly from upper ends thereof to define yoke shaped receptacles for receiving drop-in wiring therein.

5. A partition panel as set forth in claim 4, wherein:

said frame includes a third pair of horizontal stringers attached to upper ends of said arms and extending generally parallel and coplanar with said first and second pairs of stringers.

6. A partition panel as set forth in claim 5, wherein:

said vertical uprights are substantially identical, and have a tubular construction with a square transverse cross-sectional shape.

7. A partition panel as set forth in claim 6, wherein:

said stringers are substantially identical, and have a tubular construction with a square transverse cross-sectional shape.

8. A partition panel as set forth in claim 7, wherein:

said upright cross-sectional shape is substantially identical to said stringer cross-sectional shape.

9. A partition panel as set forth in claim 8, wherein:

said stringers each include a row of said slots extending therealong.

10. A partition panel as set forth in claim 9, including:

branching clips shaped to be received in the slots in said stringers for connecting like panels in a mutually perpendicular relationship.

11. A partition panel as set forth in claim 10, wherein:

said stringers include windows positioned adjacent opposite ends thereof; and including:

panel-to-panel clips shaped to be received in the windows of adjacent stringers to detachably interconnect like panels in a mutually in-line relationship.

12. A partition panel as set forth in claim 11, wherein:

said fasteners comprise cover panel clips which engage upper and lower faces of said stringers.

13. A partition panel as set forth in claim 12, wherein:

said frame includes a plurality of said vertical uprights positioned generally equidistantly between said first and second vertical uprights.

14. A partition panel as set forth in claim 13, wherein:

said foot includes a pair of vertically adjustable glides positioned adjacent the opposite side edges of said frame.

15. A partition panel as set forth in claim 14, wherein:

said horizontal stringers are substantially longer than said vertical uprights such that said partition panel has a horizontally elongated front elevational shape.

16. A partition panel as set forth in claim 15, wherein:

said frame includes a base raceway extending along the bottom portion of said panel.

17. A partition panel as set forth in claim 16, including:

an expressway utility raceway extending along a top portion of said panel.

18. A partition panel as set forth in claim 17, including:

a stacker panel connected with the top portion of said panel and upstanding therefrom to increase the overall vertical height of the same.

19. A partition panel as set forth in claim 18, wherein:

said stacker panel includes:

a skeleton-like stacker frame, having first and second stacker uprights extending vertically and positioned adjacent opposite side edges of said stacker frame with each including outwardly oriented opposite outer faces, and first and second pairs of stacker stringers extending horizontally and attached to said stacker uprights adjacent upper and lower portions thereof to rigidly interconnect said stacker uprights and define therebetween third and fourth raceway cavities which open to opposite side faces of said stacker frame, and extend continuously between the opposite side edges thereof with open ends, such that when like stacker panels are interconnected in a side-by-side relationship, the open ends of adjacent third and fourth raceway cavities are aligned and communicate;

third and fourth cover panels shaped to cover at least those partitions of the side faces of said stacker frames disposed between said first and second pairs of stacker stringers;

fasteners detachably mounting the third and forth cover panels on the outer faces of said stacker stringers to provide ready access to the third and fourth raceway cavities and permit lay-in wiring therealong.

20. A partition panel as set forth in claim 19, wherein:

said stacker frame includes a pair of arms connected with the outer faces of each at said stacker uprights and extending upwardly from upper ends thereof to define yoke shaped receptacles for receiving drop-in wiring therein.

21. A partition panel as set forth in claim 20, wherein:

said first pair of stacker stringers is attached to upper ends of said arms; and said second pair of stacker stringers is attached to the opposite outer faces of said stacker uprights.

22. A partition panel as set forth in claim 21, wherein:

said second pair of stacker stringers on said stacker frame are abuttingly supported on said first pair of horizontal stringers on said frame.

23. A partition panel as set forth in claim 1, wherein:

said stringers extend horizontally between medial portions of said vertical uprights, whereby said first and second raceway cavities define beltway raceway cavities located adjacent a worksurface height.

24. A partition panel as set forth in claim 1, wherein:

said frame includes a pair of arms connected with the outer faces of each at said vertical uprights which extending upwardly from upper ends thereof to define yoke shaped receptacles for receiving drop-in wiring therein.

25. A partition panel as set forth in claim 24, wherein:

said frame includes a third pair of horizontal stringers attached to upper ends of said arms and extending generally parallel and coplanar with said first and second pairs of stringers.

26. A partition panel as set forth in claim 1, wherein:

said stringers each include a row of said slots extending therealong.

27. A partition panel as set forth in claim 26, including:

branching clips shaped to be received in the slots in said stringers for connecting like panels in a mutually perpendicular relationship.

28. A partition panel as set forth in claim 1, wherein:

said vertical uprights are substantially identical, and have a tubular construction with a square transverse cross-sectional shape.

29. A partition panel as set forth in claim 1, wherein:

said stringers are substantially identical, and have a tubular construction with a square transverse cross-sectional shape.

30. A partition panel as set forth in claim 1, wherein:

said vertical uprights are substantially identical, and have a tubular construction with a square transverse cross-sectional shape;

said stringers are substantially identical, and have a tubular construction with a square transverse cross-sectional shape; and said upright cross-sectional shape is substantially identical to said stringer cross-sectional shape.

31. A partition panel as set forth in claim 1, wherein:

said stringers include windows positioned adjacent opposite ends thereof; and including:

panel-to-panel clips shaped to be received in the windows of adjacent stringers to detachably interconnect like panels in a mutually in-line relationship.

32. A partition panel as set forth in claim 1, wherein:

said fasteners comprise cover panel clips which frictionally engage upper and lower faces of said stringers.

33. A partition panel as set forth in claim 1, wherein:

said frame includes a plurality of said vertical uprights positioned generally equidistantly between said first and second vertical uprights.

34. A partition panel as set forth in claim 1, wherein:

said frame includes a plurality of said horizontal stringers positioned generally equidistantly between said first and second pairs of horizontal stringers.

35. A partition panel as set forth in claim 1, wherein:

said horizontal stringers are substantially longer than said vertical uprights such that said partition panel has a horizontally elongated front elevational shape.

36. A partition panel as set forth in claim 1, wherein:

said frame includes a base raceway extending along the bottom portion of said panel.

37. A partition panel as set forth in claim 1, including:

an expressway utility raceway extending along a top portion of said panel.

38. A partition panel as set forth in claim 1, including:

a stacker panel connected with a top portion of said panel and upstanding therefrom to increase the overall vertical height of the same.

39. A partition panel as set forth in claim 38, wherein:

said stacker panel includes:

a skeleton-like stacker frame, having first and second stacker uprights extending vertically and positioned adjacent opposite side edges of said stacker frame with each including outwardly oriented opposite outer faces; and first and second pairs of stacker stringers extending horizontally and attached to said stacker uprights adjacent upper and lower portions thereof to rigidly interconnect said stacker uprights and define therebetween third and fourth raceway cavities which open to opposite side faces of said stacker frame, and extend continuously between the opposite side edges thereof with open ends, such that when like stacker panels are interconnected in a side-by-side relationship, the open ends of adjacent third and fourth raceway cavities are aligned and communicate;

third and fourth cover panels shaped to cover at least those partitions of the side faces of said stacker frames disposed between said first and second pairs of stacker stringers;

fasteners detachably mounting the third and fourth cover panels on the outer faces of said stacker stringers to provide ready access to the third and fourth raceway cavities and permit lay-in wiring therealong.

40. A partition panel as set forth in claim 39, wherein:

said stacker frame includes a pair of arms connected with the outer faces of each at said stacker uprights which extending upwardly from upper ends thereof to define yoke shaped receptacles for receiving drop-in wiring therein.

41. A partition panel as set forth in claim 40, wherein:

said first pair of stacker stringers is attached to upper ends of said arms; and said second pair of stacker stringers is attached to the opposite outer faces of said stacker uprights.

42. A partition panel as set forth in claim 41, wherein:

said second pair of stacker stringers on said stacker frame are abuttingly supported on said first pair of horizontal stringers on said frame.

43. A freestanding portable partition panel for open office spaces and the like, comprising:

a skeleton-like frame, having:

first and second vertical uprights positioned adjacent opposite side edges of said frame with each including outwardly oriented opposite outer faces;

a foot extending downwardly from a bottom portion of the frame to abuttingly support said partition panel freestanding on a floor surface;

first and second pairs of horizontal stringers attached to the opposite outer faces of said vertical uprights in a vertically spaced apart relationship to rigidly interconnect said vertical uprights and define therebetween first and second horizontal raceway cavities which open to opposite side faces of said frame, and a vertical raceway cavity disposed in between said first and second horizontal raceway cavities;

at least one of said stringers having an outer planar face with a row of horizontally spaced and aligned slots therein including several intermediately located slots that are located close together for defining discrete attachment points for adjustably supporting furniture therealong; and first and second cover panels detachably mounted on opposite sides of said frame to selectively enclose said cavities yet permit access to said slots.

44. A partition panel as set forth in claim 43, wherein:

at least one of said stringers includes a row of said slots extending therealong.

45. A partition panel as set forth in claim 44, wherein:

said vertical uprights are substantially identical, and have a tubular construction with a square transverse cross-sectional shape.

46. A partition panel as set forth in claim 45, wherein:

said stringers are substantially identical, and have a tubular construction with a square transverse cross-sectional shape.

47. A partition panel as set forth in claim 46, wherein:

said upright cross-sectional shape is substantially identical to said stringer cross-sectional shape.

48. A partition panel comprising:

a partition frame including an upper horizontal frame member and a lower horizontal frame member, each including an apertured planar outer surface defining a horizontally extending row comprising several horizontally spaced and aligned slots for supporting a furniture component; and a cover panel attached to the upper and lower horizontal frame members and shaped to substantially cover a side face of the partition frame but shaped to permit selective access to the slots on the upper and lower horizontal frame members.

49. The partition panel defined in claim 48 wherein the partition frame includes uprights and wherein the upper and lower horizontal frame members comprise horizontal stringers attached to outer sides of the uprights.

50. The partition panel defined in claim 48 including off-module connectors engaging selected ones of the slots on the upper and lower horizontal frame members, the off-module connectors being constructed to support furniture components on the partition frame.

51. The partition panel defined in claim 50 wherein the off-module connectors include horizontally oriented hooks engaging the slots.

52. A freestanding portable partition panel for open office spaces and the like, comprising:

a skeleton-like frame, having:

first and second vertical uprights positioned adjacent opposite side edges of said frame with each including outwardly oriented opposite outer faces;

a foot extending downwardly from a bottom portion of said frame to abuttingly support said partition panel freestanding on a floor surface;

first and second pairs of horizontal stringers attached to said vertical uprights in a vertically spaced apart relationship to rigidly interconnect said vertical uprights and define therebetween first and second horizontal raceway cavities which open to opposite side faces of said frame, and which extend continuously between the opposite side edges thereof with open ends, such that when like partition panels are interconnected in a side-by-side relationship, the open ends of adjacent raceway cavities are aligned and communicate, said stringers each including horizontally-extending, cantilevered end sections having connector-receiving structure with apertures therein positioned proximate but spaced from ends of the stringers, and further including at least one horizontal row of slots extending onto the cantilevered end sections;

furniture components having connectors configured to engage selected ones of the slots for support;

panel-to-panel connectors including clips having one end adapted to engage the connector-receiving apertures and another end adapted to engage a corresponding connector-receiving structure on an adjacent frame to interconnect the adjacent frame to said skeleton-like frame in an in-line arrangement;

first and second cover panels shaped to cover at least those portions of the side faces of said frames disposed between said first and second pairs of horizontal stringers; and fasteners detachably mounting said cover panels on the outer faces of said stringers to provide ready access to the raceway cavities and permit lay-in wiring thereal-ong.

53. A partition panel as set forth in claim 52 wherein at least one end of said clips is hook shaped and is configured to securely hook into the associated connector-receiving aperture when engaged therewith.

54. A partition panel as set forth in claim 53 wherein said panel-to-panel connectors each include a threaded fastener threadably engaging with a body section of said clips for securing the respective clip clampingly against the frame to hold the hook shaped one end in engagement with the corresponding connector-receiving aperture.

55. A partition panel as set forth in claim 54 wherein said vertical uprights are spaced from the vertical side edges, and the ends of said stringers extend beyond the vertical uprights in a cantilevered fashion, said connector-receiving apertures being located in the ends of the stringers.

56. A partition panel system comprising:

a base frame and a stacker frame configured for rigid interconnection in a stacked arrangement, said base and stacker frames each having:

first and second vertical uprights positioned adjacent opposite side edges of each said frame with each including outwardly oriented opposite outer faces;

first and second pairs of horizontal stringers attached to the opposite outer faces of said vertical uprights in a vertically spaced apart relationship to rigidly interconnect said vertical uprights and define therebetween first and second horizontal raceway cavities which open to opposite side faces of each said frame, and which extend continuously between the opposite side edges thereof with open ends, such that when like partition panels are interconnected in a side-by-side relationship, the open ends of adjacent raceway cavities are aligned and communicate, the first and second outer faces each including at least one horizontal row of slots extending across the panel to define discrete attachment points;

said base frame including upper frame structure defining a continuous upper horizontal edge, and said stacker frame including lower frame structure including downwardly extending stacking connectors for engaging the base frame to connect the stacker frame to the base frame in the stacked arrangement; and first and second cover panels shaped to cover at least those portions of the side faces of each of said frames disposed between said first and second pairs of horizontal stringers of each said frame; and furniture components having connectors configured to engage selected ones of the slots for support.

57. A partition panel system as set forth in claim 56 wherein said stacking connectors include threaded fasteners.

58. A partition panel system as set forth in claim 57 wherein said upper frame structure includes said first stringers of said base frame, and wherein said lower frame structure includes said second stringers of said stacker frame.

59. A partition panel system as set forth in claim 58 wherein said stacking connector includes downwardly protruding sleeves that facilitate alignment of the stacker frame on the base frame and that receive said threaded fasteners.

60. A partition panel system comprising:

a welded matrix-type base frame including a first layer of elongated structural members that extend horizontally between vertical side edges of the base frame in a first direction and including at least one second layer of elongated structural members that extend vertically between horizontal side edges of the base frame perpendicular to the first direction, at least one of the first and second structural members in the base frame including a face defining a horizontal row of slots defining discrete attachment points;

a welded matrix-type stacker frame including a third layer of elongated structural members that extend horizontally between vertical side edges of the stacker frame in the first direction and at least one fourth layer of elongated structural members that extend vertically between horizontal side edges of the stacker frame perpendicular to the first direction;

downwardly extending stacking connectors attached to the stacker frame at a location intermediate the vertical side edges of the stacker frame, the stacking connectors engaging the base frame for rigidly interconnecting the matrix-type stacker frame to the matrix-type base frame to form an interconnected assembly permitting flexible routing of utilities throughout the interconnected assembly between the first, second, third, and fourth layers; and a plurality of removable cover panels shaped to cover portions of said base frame and said stacker frame, the removable cover panels including cover connectors for engaging selected ones of the structural members of the base frame and the stacker frame, the cover panels further being shaped to allow access to the slots; and furniture components configured to engage selected ones of the slots for support.

61. A partition panel system as set forth in claim 60 wherein at least one of said structural members in said first layer includes an apertured outer face defining a plurality of horizontally spaced and aligned slots that in turn define at least three discrete attachment points along a length of said at least one structural member for adjustably supporting a furniture component.

62. A partition panel system as set forth in claim 60 including a welded matrix-type off-module frame, the off-module frame including a fifth layer of elongated structural members that extend horizontally between vertical side edges of the off-module frame in a horizontal direction and including at least one sixth layer of elongated structural members that extend vertically between horizontal side edges of the off-module frame, at least one of the structural members on the base frame including connector receiving apertures located between the vertical side edges thereof and the off-module frame including off-module connectors for engaging selected ones of the connector receiving apertures to retain the off-module frame to the base frame.

63. A partition panel system as set forth in claim 60 wherein said vertical structural members in the second layer are located inboard of the vertical side edges of the base frame, and said stacking connectors are located inboard or below said vertical structural members in said second layer.

64. A freestanding portable partition panel for open office spaces and the like, comprising:

a frame having vertical uprights and first and second pairs of horizontal stringers welded together to define a rigid structure having an open interior space, said horizontal stringers each including outwardly oriented opposite outer faces defining a row of horizontally spaced and aligned slots that in turn define several discrete intermediately-located attachment points along a length of said first horizontal stringers for adjustably supporting a furniture component such as an "off-module" partition, at least two of said slots being located close together and generally in a middle of the first horizontal stringers;

a foot extending downwardly from a bottom portion of said frame to abuttingly support said partition panel freestanding on a floor surface;

a plurality of detachable cover panels shaped to cover at least those portions of the side faces of said frame disposed between said first and second pairs of horizontal stringers, but which permit ready access to said slots when attached to said frame and to said interior space when removed from said frame.

65. A freestanding portable partition panel for open office spaces and the like, comprising:

a skeleton-like frame, having:

first and second vertical uprights positioned adjacent opposite side edges of said frame with each including outwardly oriented opposite outer faces;

a foot extending downwardly from a bottom portion of said frame to abuttingly support said partition panel freestanding on a floor surface;

first and second pairs of horizontal stringers attached to the opposite outer faces of said vertical uprights in a vertically spaced apart relationship to rigidly interconnect said vertical uprights and define therebetween first and second horizontal raceway cavities which open to opposite side faces of said frame, and which extend continuously between the opposite side edges thereof with open ends, such that when like partition panels are interconnected in a side-by-side relationship, the open ends of adjacent raceway cavities are aligned and communicate; said vertical uprights being spaced inboard from the vertical side edges, and said stringers including end sections extending beyond the vertical uprights in a cantilevered fashion;

first and second detachable cover panels shaped to cover at least those portions of the side faces of said frames disposed between said first and second pairs of horizontal stringers, said cover panels being detachably mounted on the outer faces of said stringers to provide ready access to the raceway cavities for permitting lay-in wiring therealong.

66. A partition panel as set forth in claim 65 wherein said end sections each include a planar outer face having several horizontally aligned slots therein for receiving attachment brackets.

67. A freestanding portable partition panel for open office spaces and the like, comprising:

a skeleton-like base frame and a skeleton-like stacker frame configured for interconnection in a stacked arrangement, each having:

an inner layer comprising first and second spaced apart vertical uprights positioned proximate opposite side edges of said frame with each including outwardly oriented opposite outer faces;

opposing outer layers comprising first and second pairs of horizontal stringers attached to the opposite outer faces of said vertical uprights in a vertically spaced apart relationship to rigidly interconnect said vertical uprights and define therebetween first and second horizontal raceway cavities which open to opposite side faces of said frame, and which extend continuously between the opposite side edges thereof with open ends, such that when like partition panels are interconnected in a side-by-side relationship, the open ends of adjacent raceway cavities are aligned and communicate, at least said first pair of horizontal stringers each including an apertured planar outer face defining a plurality of horizontally spaced and aligned slots including at least three closely-positioned intermediately-located slots that in turn define at least three discrete intermediate attachment points along a length of said first stringers for adjustably supporting a furniture component such as an "off-module" partition;

said base frame further including a foot extending downwardly from a bottom portion of said frame to abuttingly support said partition panel freestanding on a floor surface;

said base frame still further including upper frame structure having upwardly open apertures, and said stacker frame including downwardly protruding stacker connectors for mateably engaging the upwardly open apertures to locate the stacker frame on the base frame and for securing the stacker frame to the base frame in a stacked arrangement, the stacker connectors including a downwardly extending engagement member for mateably engaging the upwardly open apertures and also including threaded fasteners for threadably engaging the downwardly extending engagement member;

said stringers of said base frame each including connector-receiving structure with end-located apertures therein positioned proximate but spaced from ends of the stringers of said base frame;

panel-to-panel connectors including clips with a hook end adapted to engage the end-located apertures and another end adapted to engage a corresponding connector-receiving structure on an adjacent base frame to interconnect the adjacent base frame to said skeleton-like base frame in an in-line arrangement;

a plurality of cover panels shaped to cover at least those portions of the side faces of said base and stacker frames disposed between said first and second pairs of horizontal stringers but also shaped to permit access to the slots; and fasteners detachably mounting said cover panels on the outer faces of said stringers to provide ready access to the raceway cavities and permit lay-in wiring therealong.

68. A wall construction for subdividing a building work space, comprising:

a first partition panel having vertical side edges and further having a frame defining a horizontal row of spaced apart slots, the slots defining several discrete attachment points across the frame member, the first partition panel including cover panels attached to the frame that are shaped to permit access to the slots, the row extending substantially across a width of the first partition panel and the slots being accessible from a front of the first partition panel;

an off-module connector securely engaging selected ones of the slots at a horizontal location spaced from the vertical side edges in an off-module position, the off-module connector further including a protruding flange which extends forwardly from the first partition panel; and a furniture accessory having a marginal edge positioned adjacent the front of the first partition panel, the furniture accessory engaging the protruding flange to secure the furniture accessory to the first partition panel in a selected horizontal position.

69. The wall construction defined in claim 68 wherein the furniture accessory comprises a second partition panel.

70. The wall construction defined in claim 68 wherein the off-module connector includes horizontally facing hooks.

71. A wall construction for subdividing a building work space, comprising:

a first partition panel having vertical side edges and further having a horizontally extending frame member defining a horizontal row of spaced apart discrete attachment locations, the first partition panel including a pair of vertically juxtaposed cover panels attached to the frame so that adjacent edges of the cover panels define a gap therebetween, the row extending substantially across a width of the first partition panel and the discrete attachment locations being accessible from a front of the first partition panel through the gap; and a furniture accessory including an off-module connector extending through the gap and securely engaging selected ones of the discrete attachment locations at a horizontal location intermediate The vertical side edges in a selected off-module position, the furniture accessory being in front of the first partition panel.

72. The wall construction defined in claim 71 wherein the furniture accessory comprises a second partition panel having a marginal edge positioned adjacent the front of the first partition panel, the off-module connector of the second partition panel securing the second partition panel in a generally perpendicular relationship to the first partition panel.

73. The wall construction defined in claim 71 wherein the off-module connector includes horizontally facing hooks engaging the discrete attachment locations.

74. A partition panel comprising:

vertical uprights;

a first and a second pair of horizontal stringers attached to an outer side of the vertical uprights defining horizontal raceway cavities with at least the first pair of stringers including an apertured planar outer surface defining a row of horizontally spaced and aligned slots for supporting a furniture component; and cover panels attached to the first pair of stringers, the cover panels being shaped to cover a side face of the frame and permit horizontal access to the slots.

75. A partition panel comprising:

a partition frame having a planar face with a horizontal row of bracket-receiving apertures therein, the partition frame being constructed to support furniture components;

a cover panel attached to the partition frame, the cover panel including top and bottom side edges that define at least one side of an access space to allow access to the bracket-receiving apertures; and a bracket having a connector portion that extends through the at least one access space and into engagement with selected ones of the bracket-receiving apertures, the bracket being configured to support furniture components on the partition frame.

* * * * *

US005746034B1

REEXAMINATION CERTIFICATE (4180th)

United States Patent [19] [11] B1 5,746,034

Luchetti et al. [45] Certificate Issued Oct. 17, 2000

[54] PARTITION SYSTEM

[75] Inventors: Robert J. Luchetti, Cambridge; Gregg Robert Draudt, Watertown, both of Mass.; James Bender Eldon, III, Barto; David Dean McClanahan, Harleysville, both of Pa.

[73] Assignee: Steelcase Inc., Grand Rapids, Mich.

Reexamination Request:
No. 90/005,455, Aug. 17, 1999

Reexamination Certificate for:

| | |
|---|---|
| Patent No.: | **5,746,034** |
| Issued: | **May 5, 1998** |
| Appl. No.: | **08/367,802** |
| Filed: | **Dec. 30, 1994** |

[51] Int. Cl.[7] ..... E04B 2/76

[52] U.S. Cl. ..... 52/220.7; 52/36.1; 52/36.6; 52/239

[56] References Cited

U.S. PATENT DOCUMENTS

| | | |
|---|---|---|
| 3,514,883 | 6/1970 | Albright . |
| 4,619,486 | 10/1986 | Hannah et al. . |
| 4,883,330 | 11/1989 | Armstrong et al. . |

OTHER PUBLICATIONS

Exhibit A is a brochure entitled *Knoll—Hannah Desk System,* 18 pages, dated Oct. 1986.

Exhibit B is a brochure entitled *Knoll—Hannah Desk System,* 13 pages, undated but published in 1986.

Exhibit C is a publication entitled *Knoll—Hannah Desk System—Electrical Assembly Guide,* (12 pages), undated but published in 1986.

Exhibit D is a publication entitled *Knoll—Hannah Desk System—Assembly Guide,* 12 pages, undated but published in 1986.

*Primary Examiner*—M Safavi

[57] ABSTRACT

A freestanding portable partition panel and related system are provided for open office spaces and the like. Each panel includes a skeleton-like frame having two vertical uprights positioned adjacent opposite side edges thereof. A foot extends downwardly from the bottom of the frame to abuttingly support the panel freestanding on a floor surface. Two pairs of horizontal stringers are attached to the outer faces of the uprights in a vertically spaced apart relationship to rigidly interconnect the same, and define therebetween two horizontal raceway cavities which open to the opposite side faces of the frame, and extend continuously between the opposite side edges thereof. Hence, when like panels are interconnected side-by-side, the open ends of adjacent raceway cavities are aligned and communicate. Cover panels enclose at least those portions of the frame side faces disposed between the stringers, and are detachably mounted thereon to provide ready access to the raceway cavities and permit lay-in wiring therealong. The upper ends of the vertical uprights have upwardly extending arms which define yoke shaped receptacles for receiving drop-in wiring.

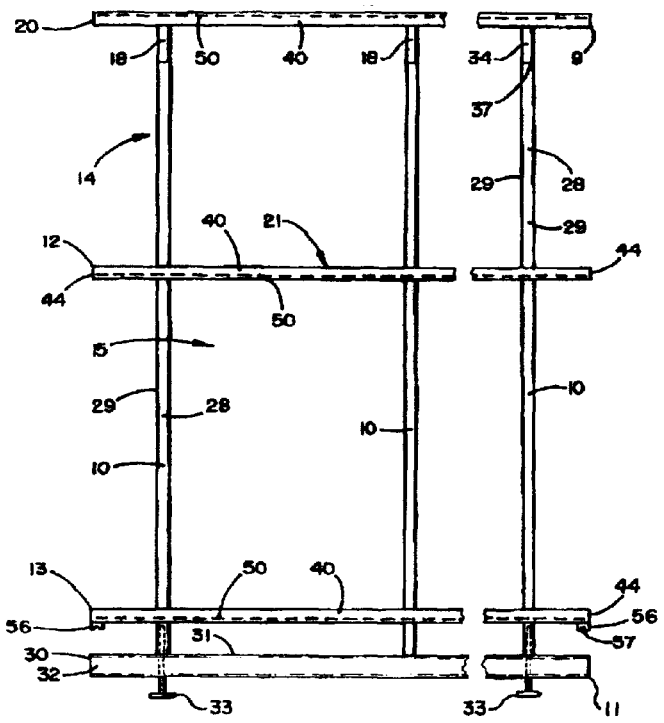

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–75 is confirmed.

* * * * *